US007252414B2

(12) United States Patent
Chabert

(10) Patent No.: US 7,252,414 B2
(45) Date of Patent: Aug. 7, 2007

(54) ILLUMINATING BALLOON WITH IMPROVED SELF-INFLATABLE ENVELOPE

(75) Inventor: Pierre Chabert, Saint Martin d'Heres (FR)

(73) Assignee: Airstar, Champ Pres Froges (FR)

( * ) Notice: Subject to any disclaimer, the term of this patent is extended or adjusted under 35 U.S.C. 154(b) by 104 days.

(21) Appl. No.: 11/075,691

(22) Filed: Mar. 10, 2005

(65) Prior Publication Data

US 2005/0207168 A1 Sep. 22, 2005

(30) Foreign Application Priority Data

Mar. 19, 2004 (FR) ..... 04 02856

(51) Int. Cl.
*F21S 13/10* (2006.01)

(52) U.S. Cl. ..... 362/363; 362/96; 362/394; 362/352

(58) Field of Classification Search ..... 362/363, 362/352, 96, 294, 377; 446/220, 219
See application file for complete search history.

(56) References Cited

U.S. PATENT DOCUMENTS 2,871,343 A * 1/1959 Whitney ..... 362/363
4,292,999 A * 10/1981 Szollmann ..... 137/560
4,542,445 A * 9/1985 Marletta ..... 362/96
6,012,826 A * 1/2000 Chabert ..... 362/363
6,142,415 A * 11/2000 Ambrico ..... 244/33
6,527,418 B1 3/2003 Scherba

FOREIGN PATENT DOCUMENTS

| | | |
|---|---|---|
| DE | 85 06 181.6 U1 | 11/1985 |
| FR | 2 754 040 A1 | 4/1998 |
| FR | 2 801 092 A1 | 5/2001 |
| JP | A 9-306210 | 11/1997 |
| WO | WO 02/063207 A1 | 8/2002 |
| WO | WO 02/095288 A1 | 11/2002 |

* cited by examiner

*Primary Examiner*—Renee Luebke
*Assistant Examiner*—Gunyoung T. Lee
(74) *Attorney, Agent, or Firm*—Oliff & Berridge, PLC

(57) ABSTRACT

An illuminating balloon with an inflatable envelope contains an illumination system having at least one electric light bulb, and inflating means equipped with an integrated fan designed to suck air in from the outside and to inject it into the envelope while keeping the latter in the inflated state. The assembly formed by the bulb and fan is covered by a bowl made of transparent or translucent plastic material, forming an explosion-proof isolating shield and a deflector of the discharge air for inflation of the envelope via passage apertures provided in the bowl.

8 Claims, 5 Drawing Sheets

ILLUMINATING BALLOON WITH IMPROVED SELF-INFLATABLE ENVELOPE

BACKGROUND OF THE INVENTION

The invention relates to an illuminating balloon with an inflatable envelope containing an illumination system having at least one electric light bulb, inflating means equipped with an integrated fan designed to suck air in from the outside and to inject it into the envelope while keeping the latter in the inflated state, a support means of the assembly formed by the bulb and fan, and electric power supply means. Such a balloon can be used for various outdoor or indoor illumination applications.

STATE OF THE ART

The document FR-A-2,754,040 describes an illuminating balloon with an envelope made of flexible fabric self-inflating by means of an integrated booster. The envelope contains a high-power electric light bulb protected by a metal grid. The grid is extended up to the top of the envelope and prevents the envelope from coming into contact with the bulb, in particular in the case of deflation. The grid is formed by rigid metal wires distributed angularly around the bulb. In case of accidental explosion of the electric light bulb, for example when an impact or a sudden voltage surge not detected by the electrical cabinet protective devices occurs, the debris of the bulb may pierce the envelope and cause damage in the outside environment. The presence of the grid also casts shadow zones in the lighting field emitted by the balloon. The base of the envelope is equipped with a fixing flange able to be fitted by assembly means onto a support plate of the control unit.

The document U.S. Pat. No. 6,527,418 discloses an illuminating device composed of a bulb housed in a protective tube, wherein a cooling air flow provided by a fan circulates. The assembly can be suspended in an inflatable structure.

The document DE 8,506,181 refers to an inflatable balloon having at its base an opening into which the lighting unit is inserted. The latter comprises a transparent envelope containing the bulb, and comprises an end-piece to enable air to be injected via holes. There is no fan, and the bulb remains positioned in the bottom part of the balloon.

OBJECT OF THE INVENTION

The object of the invention is to provide an illuminating balloon having an easily interchangeable self-inflatable envelope, and enabling an optimum lighting field to be obtained without any shadow zones, and enabling total safety to be achieved in case of accidental explosion of the electric light bulb.

The device according to the invention is characterized in that the assembly formed by the bulb and fan is covered by a bowl made of transparent or translucent plastic material, forming both an explosion-proof isolating shield and a deflector of the discharge air enabling both cooling of the bulb and inflation of the envelope, the bowl having passage apertures for air to flow to the internal volume of the envelope to perform said inflation.

The passage apertures are preferably arranged in the upper part of the bowl to perform inflation of the envelope via the top. The bowl comprises at its base an open end bounded by an annular rim coming into engagement with a bearing surface of the support plate.

According to a first embodiment, the envelope comprises a circular opening bearing on the annular rim of the bowl due to the action of the internal pressure generated in the envelope when inflation takes place. The envelope is thus simply placed on the rim and is fixed to the top of the bowl by a fixing means, for example a simple screw or nut.

To remove the envelope, all that has to be done is to remove the fixing means at the top part and pull the envelope upwards. The bulb can remain lit during this envelope replacement operation.

According to a second embodiment, the envelope is secured to a support plate by fixing means.

The transparent plastic material of the bowl is polycarbonate-based, which enables a uniform lighting field without any shadow zones to be generated.

According to one feature of the invention, the bowl has a revolution shape extending over the whole height of the balloon.

A safety thermostat is housed in the envelope to interrupt the power supply of the bulb automatically should the fan stop working.

BRIEF DESCRIPTION OF THE DRAWINGS

Other advantages and features will become more clearly apparent from the following description of an embodiment of the invention, given as a non-restrictive example only, and represented in the accompanying drawings in which.

DESCRIPTION OF A PREFERRED EMBODIMENT

Figure 1:
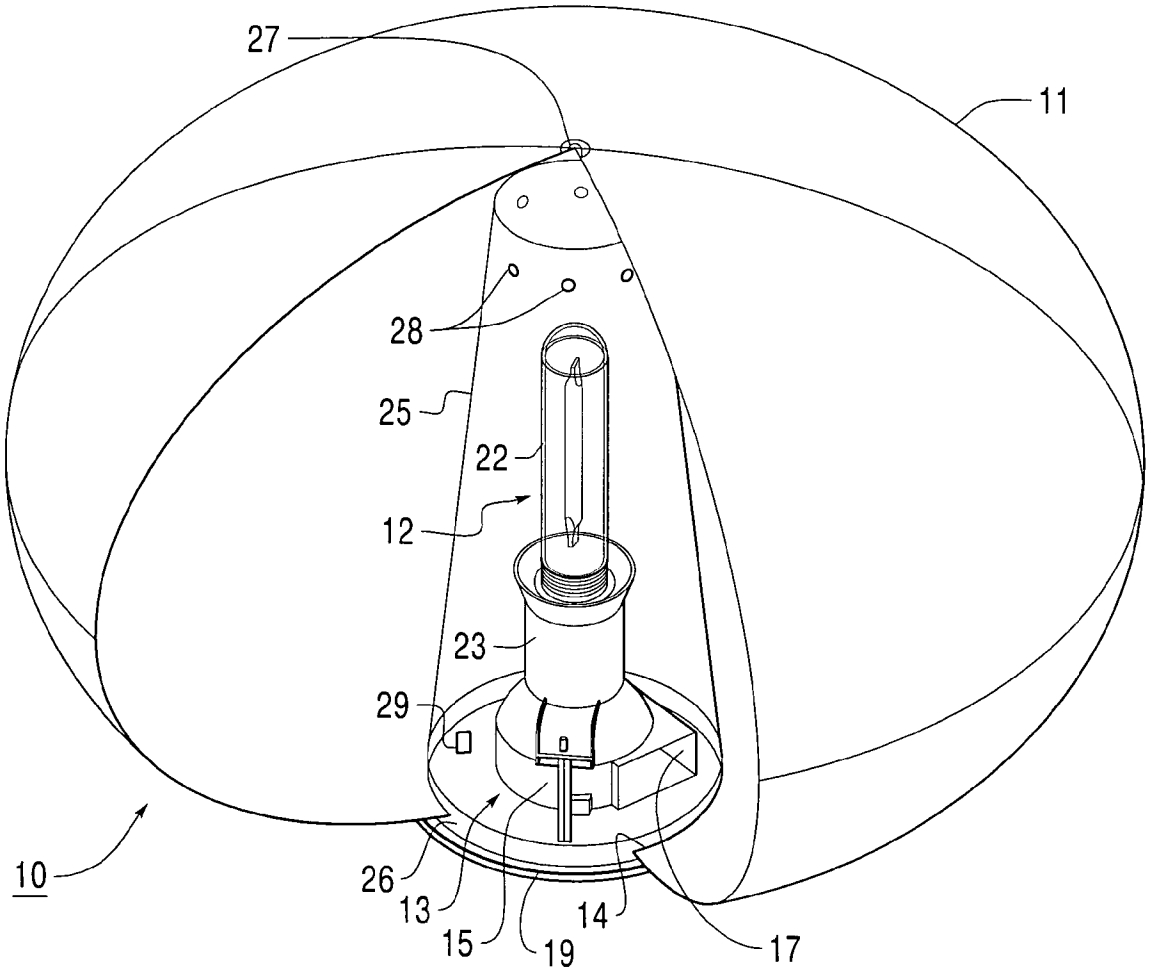
FIG. 1 is a partially cutaway perspective view of an illuminating balloon according to the invention.

In FIGS. 1 to 4, an illuminating balloon 10 comprises an inflatable envelope 11 containing an illuminating system 12 and automatic inflation means 13 designed to suck air in from the outside to inject it into the envelope 11 while keeping it in the inflated state.

The envelope 11 is made from a flexible plastic fabric and presents for example an elliptical or spherical shape obtained by assembly of several sectors of cut fabric, generally sewn together. The base of the envelope 11 comprises a circular opening 14 enabling the illuminating system 12 to be inserted, and inflation means 13.

The inflation means 13 comprise a fan 15 or suction unit having a suction orifice 16 in communication with the outside, and a discharge orifice 17 communicating with the inside of the envelope 11. The fan 15 is mounted on the inside wall of a metal plate 18 the periphery whereof is equipped with an annular bearing surface 19 having a slightly larger diameter than that of the opening 14 of the envelope 11. The plate 18 is provided with at least one hole 20 to enable air to be sucked in from the outside and for the power supply conductors connected to an external power source to pass through. An attachment device 21 is also fixed to the external face of the plate 18 for engagement of an external support mast of the balloon 10.

Inside the envelope 11, the illuminating system 12 comprises at least one electric light bulb 22 housed in an insulating sleeve 23 mounted on a rail 24 above the fan 15. The assembly formed by the bulb 22 and fan 15 is covered by a bowl 25 made of molded plastic material of small thickness. The material of the bowl 25 can be polycarbonate-based or any other transparent or translucent plastic material.

The bowl 25 is substantially frustum-shaped having at its base an open end bounded by an annular rim 26 which is in engagement with the bearing surface 19 of the plate 18. The upper part of the bowl 25 is extended up to the top of the envelope 11 and is attached thereto by a fixing means 27.

The bowl 25 is provided with several passage apertures 28 enabling the discharge air from the fan 15 to be evacuated to inflate the envelope 11 of the balloon 10. The passage apertures 28 are preferably provided in the upper part of the bowl 25 so as to perform inflation of the envelope 11 via the top.

According to a first embodiment, the envelope 11 is simply placed around the bowl 25 and its circular opening 14 bears on the rim 26, being firmly pressed thereon by the internal pressure prevailing in the envelope 11 when inflation takes place. The rim 26 can advantageously present a frustum-shaped profile to enhance the air-tightness effect with the opening 14 when inflation is performed.

The only mechanical attachment point of the envelope 11 is located at the top by means of the fixing means 27 which secure it to the top part of the bowl 25. The fixing means 27 can be a simple screw or nut, easily accessible when removal of the envelope 11 is performed.

Figure 2:
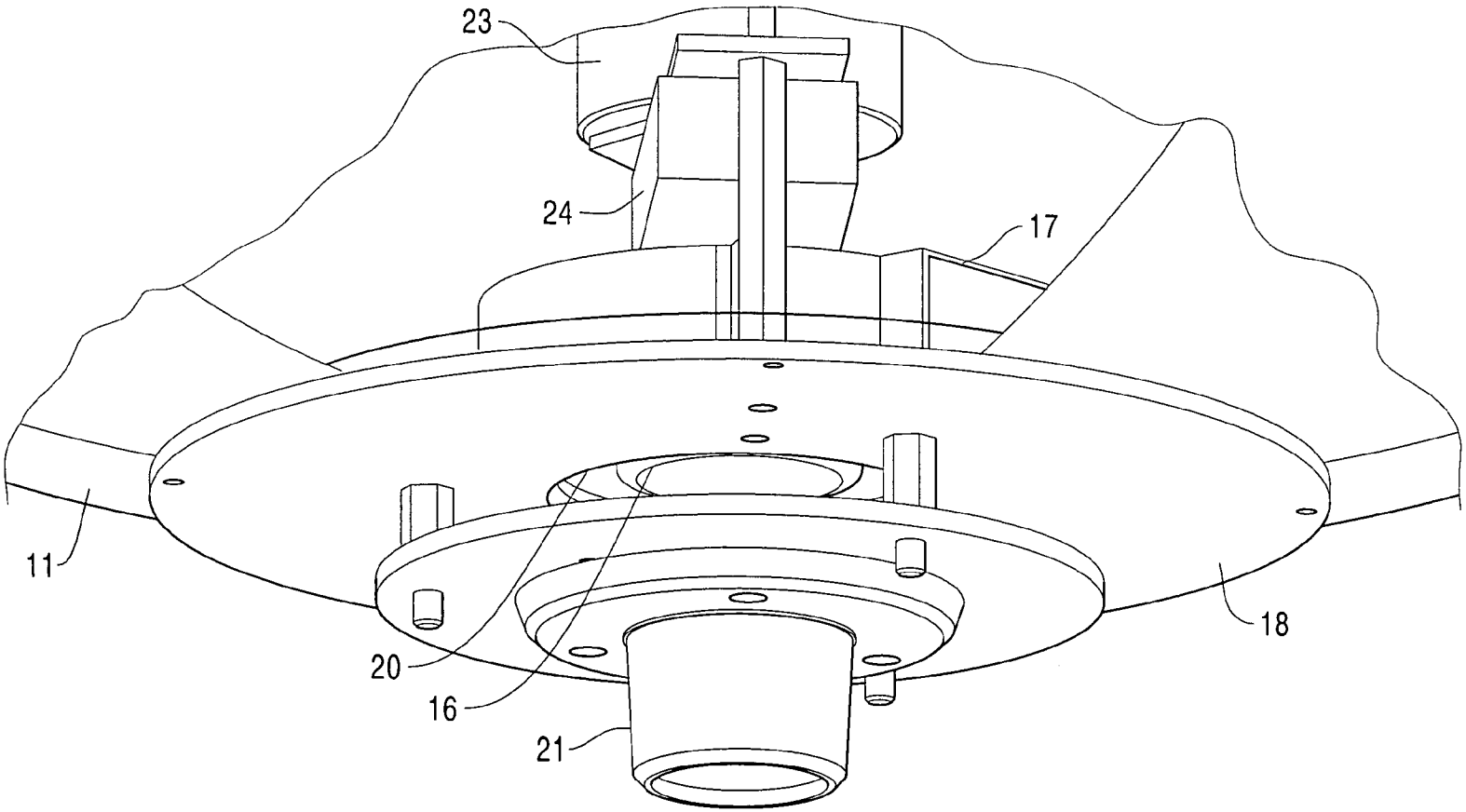
FIG. 2 shows a view on an enlarged scale of a detail of the embodiment of FIG. 1, illustrating the support plate at the base of the balloon.
Figure 3:
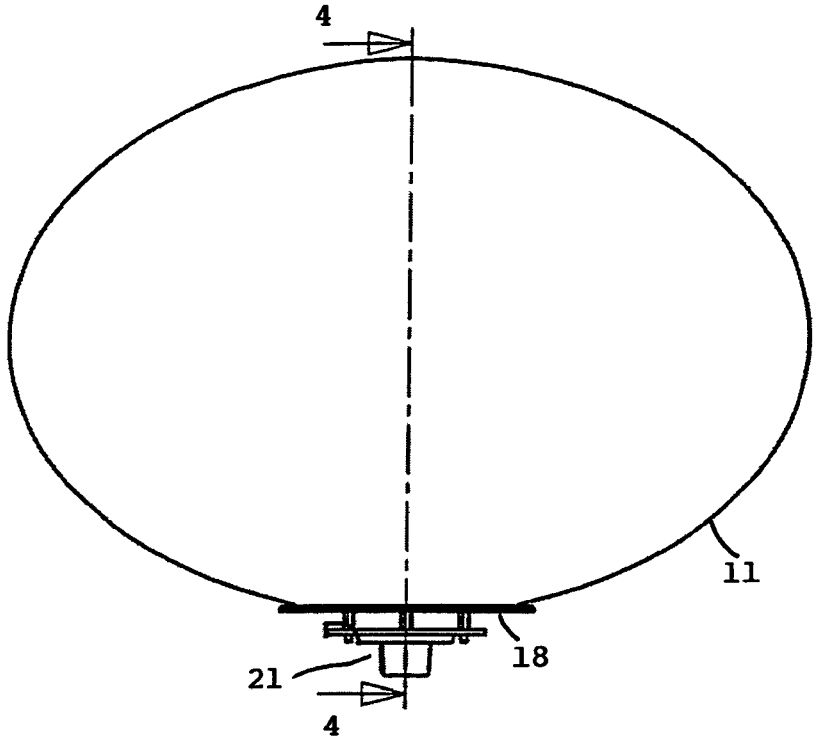
FIG. 3 represents an elevation of the balloon of FIG. 1.
Figure 4:
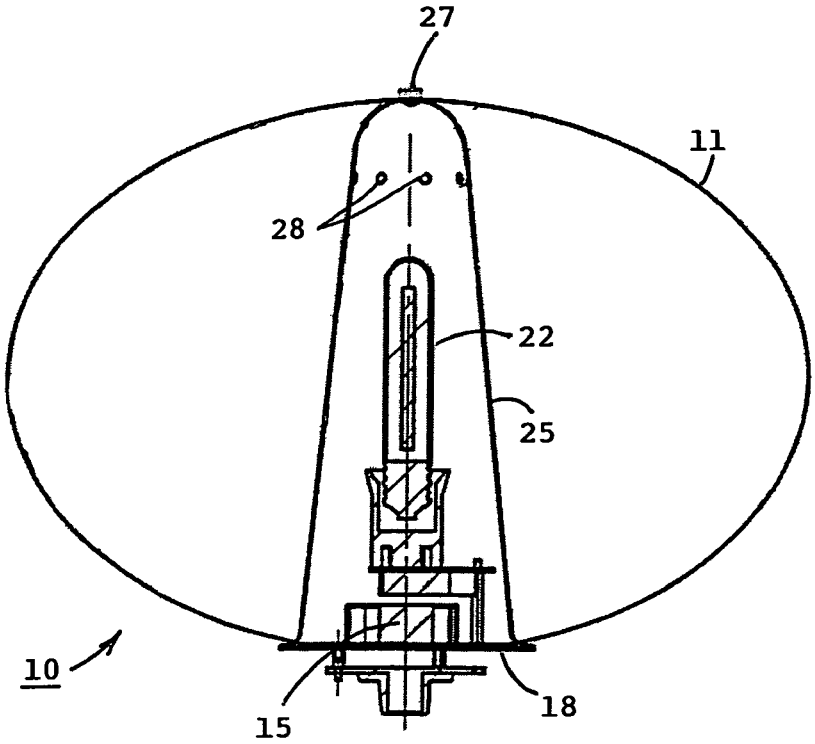
FIG. 4 is a cross-sectional view along the line 4—4 of FIG. 3.

According to a second embodiment, the envelope 11 is arranged around the bowl 25, and comprises a circular opening 14 securedly fixed to the annular edge 26 of the bowl 25 by fixing means. The latter are formed for example by screws (not shown) passing through holes 30 arranged in the plate 18 (FIG. 2).

A safety thermostat 29 is provided to monitor the temperature inside the balloon 10 and to interrupt the power supply of the bulb 22 automatically in case of accidental stoppage of the fan 15.

The polycarbonate material of the bowl 25 preferably contains protective chemical agents which make it insensitive to ultraviolet rays. The transparency of the bowl 25 is not impaired with time, and enables a uniform lighting field without any shadow zones to be obtained.

The presence of the molded plastic bowl 25 moreover procures a twofold function of explosion-proof isolating shield in case of accidental explosion of the bulb 22, and of deflector of the discharge air for inflation of the envelope 11 via the top.

To remove the envelope 11, all that has to be done is to remove the fixing means 27 and pull the envelope 11 upwards, after having first unscrewed the fixing screws at the level of the plate 18. The opening 14 of the envelope 11 leaves the rim 26 and enables the air imprisoned in the envelope 11 to escape completely. The power supply of the bulb 22 and fan 15 does not have to be shut down during this removal of the envelope 11. The bulb 22 can therefore remain lit during this replacement operation of the envelope 11 which is performed very quickly.

Depending on the volume of the envelope 11, bulbs of different powers up to 2000 W and of different voltages can be used.

Figure 5:
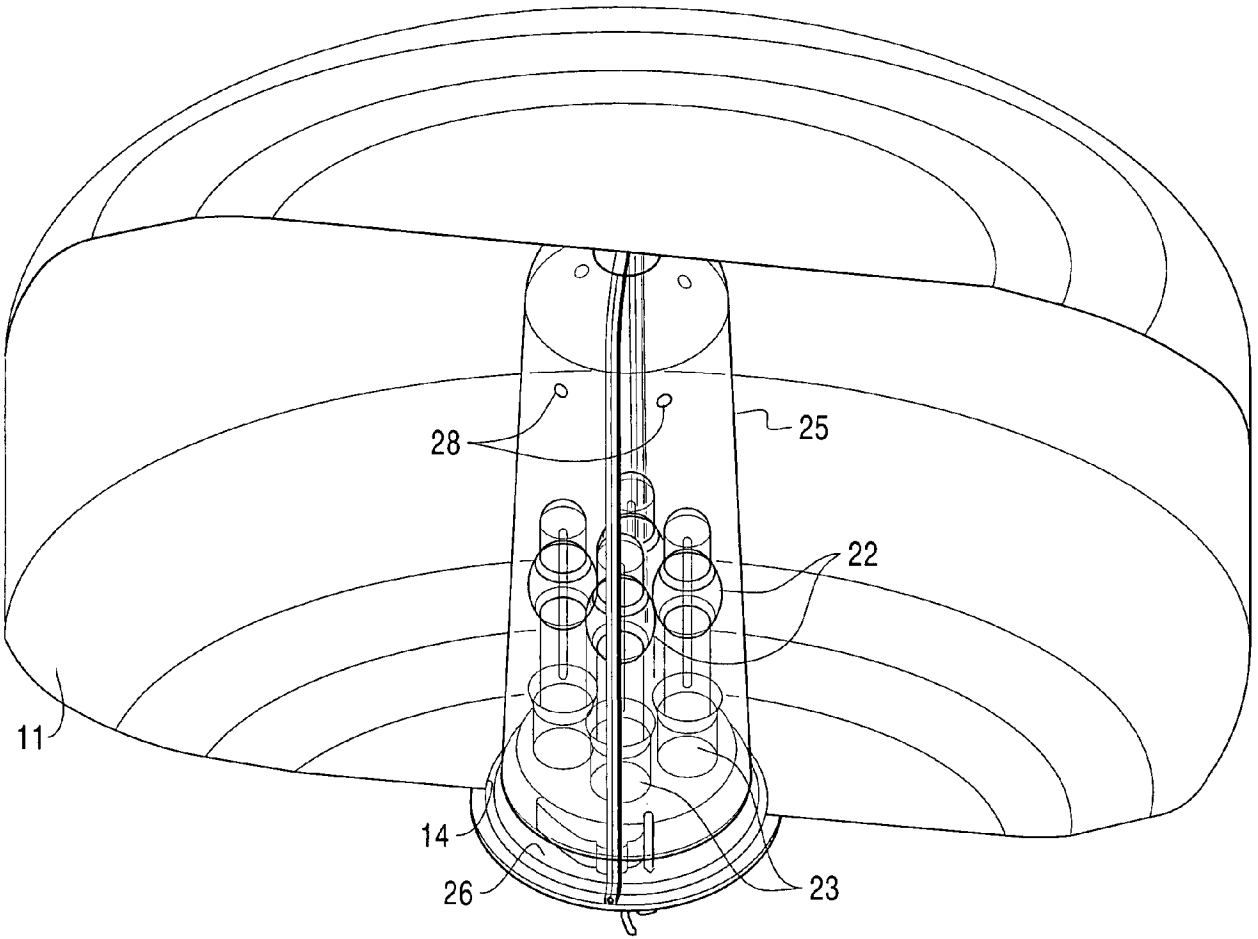
FIG. 5 shows a perspective view of an alternative embodiment with an illumination system with four bulbs, the inflatable envelope being partially cutaway in half.
Figure 6:
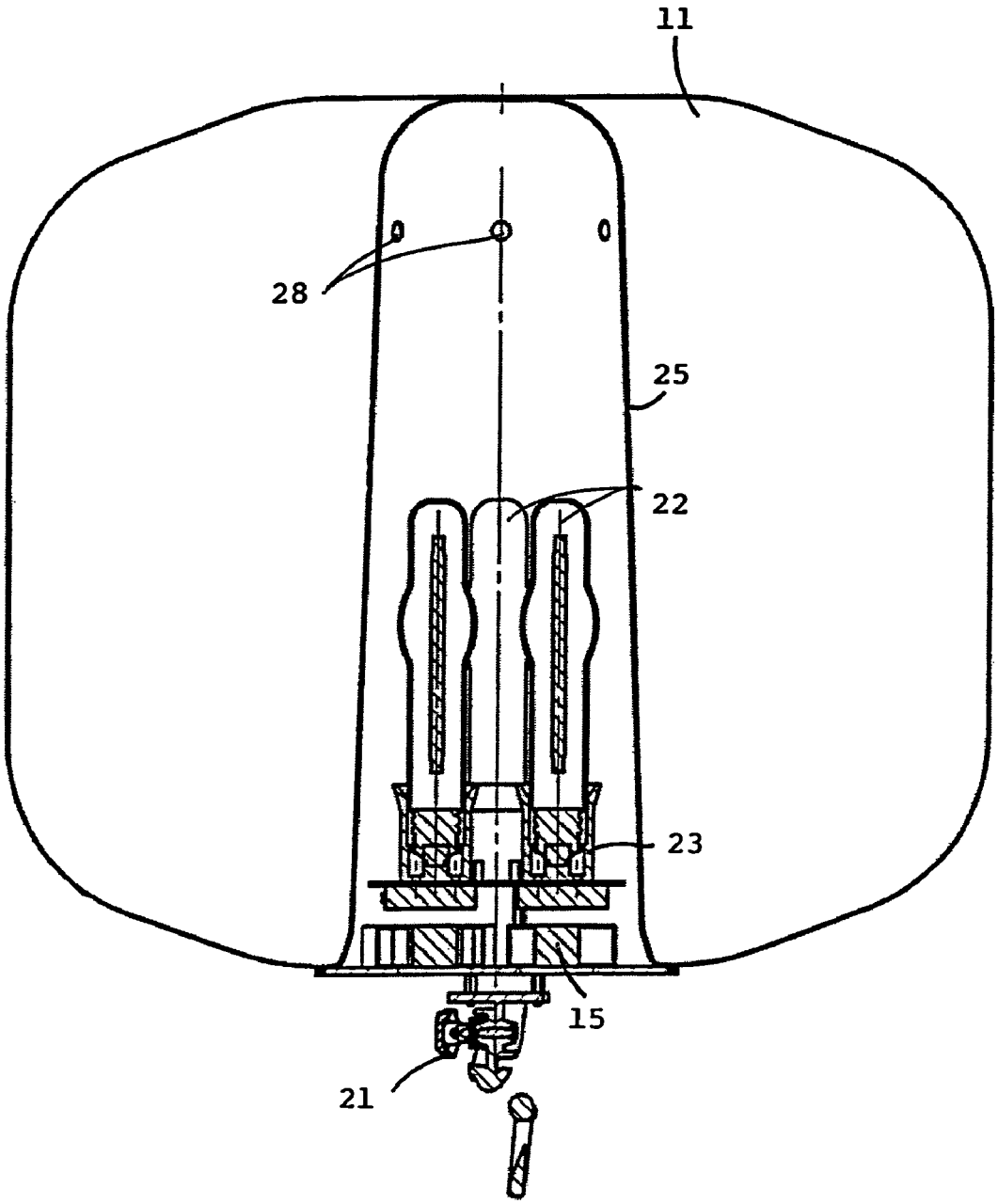
FIG. 6 is a cross-sectional view of the balloon of FIG. 5.

In FIGS. 5 and 6, the illumination system 12 comprises several electric light bulbs 22, for example four, housed in insulating sleeves 23 inside the bowl 25. The volume of the envelope 11 and of the bowl 25 is larger than those of FIG. 1 comprising a single bulb.

The invention claimed is:

1. Illuminating balloon comprising:

an inflatable envelope defining an internal space and a base with an opening;

an illumination system having at least one electric light-bulb;

inflating means having an integrated fan for sucking air from outside of the envelopes, and injecting said air into the envelope;

an assembly formed by said fan and the illumination system;

a support means including a plate for supporting the assembly;

a bowl having a first end and a second end, the second end having a diameter larger than a diameter of the first end, and made of unitary transparent or translucent material for covering said assembly, the assembly being disposed within the internal space, the bowl having a top portion attached to the envelope by a removable fixing means so as to form unitary explosion-proof isolating shield and a deflector of the air coming from the fan;

passage apertures located on the first end of said bowl to allow said air to flow to the internal space for inflation of said envelope; and said envelope being disposed around the bowl, and attached to the plate wherein the plate is disposed closer to the second end than the first end.

2. Illuminating balloon according to claim 1, wherein the passage apertures are arranged in the top part of the bowl to perform inflation of the envelope via the top part.

3. Illuminating balloon according to claim 1, wherein the bowl includes at the base an open end bounded by an annular rim coming into engagement with a bearing surface of the support means.

4. Illuminating balloon according to claim 3, wherein the circular opening of the envelope bears on said annular rim of the bowl due to the action of an internal pressure, the edge of the bowl comprising a frustum-shaped profile operating in conjunction with the circular opening of the envelope to enhance the air-tightness when inflation is performed.

5. Illuminating balloon according to claim 3, wherein the envelope is securely fixed onto the annular edge of the bowl by fixing means.

6. Illuminating balloon according to claim 1, wherein the plastic material of the bowl is polycarbonate-based.

7. Illuminating balloon according to claim 1, wherein the bowl has a revolution shape extending above the top part of the balloon.

8. Illuminating balloon according to claim 1, wherein a safety thermostat is housed in the envelope to automatically interrupt the power supply of the bulb in case of stoppage of the fan.

* * * * *